US007735979B2

(12) United States Patent
Katayama

(10) Patent No.: US 7,735,979 B2
(45) Date of Patent: Jun. 15, 2010

(54) INK-JET PRINTER AND HEAD FOR THE SAME

(75) Inventor: Naoki Katayama, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 811 days.

(21) Appl. No.: 11/495,543

(22) Filed: Jul. 31, 2006

(65) Prior Publication Data

US 2007/0024680 A1 Feb. 1, 2007

(30) Foreign Application Priority Data

Jul. 29, 2005 (JP) ..... 2005-219932

(51) Int. Cl.
*B41J 2/045* (2006.01)

(52) U.S. Cl. ..... 347/71; 347/68

(58) Field of Classification Search ..... 347/65, 347/68–72

See application file for complete search history.

(56) References Cited

U.S. PATENT DOCUMENTS 6,206,501 B1 * 3/2001 Ishii et al. ..... 347/40

6,406,135 B1 * 6/2002 Watanabe et al. ..... 347/65

FOREIGN PATENT DOCUMENTS

JP 2001 30483 2/2001

* cited by examiner

*Primary Examiner*—Stephen D Meier
*Assistant Examiner*—Geoffrey Mruk
(74) *Attorney, Agent, or Firm*—Baker Botts LLP.

(57) ABSTRACT

A cavity unit of an ink-jet printer head includes elongated pressure chambers, a manifold, and communicating channels between pressure chambers and the manifold. Each of the communicating channels has a first straight portion and a second straight portion which are recesses extending in a longitudinal direction of the pressure chambers, and a bent portion which communicates the first straight portions and the second straight portions. In a plan view, each of the communicating channels overlaps entirely with a pressure chamber communicating with the communicating channel. Accordingly, there is provided an ink-jet printer head having a substantial throttle resistance and a long communicating channel, in which there is no effect of a cross-talk between the pressure chambers.

18 Claims, 17 Drawing Sheets

INK-JET PRINTER AND HEAD FOR THE SAME

CROSS REFERENCE TO RELATED APPLICATION

The present application claims priority from Japanese Patent Application No. 2005-219932, filed on Jul. 29, 2005, the disclosure of which is incorporated herein by reference in its entirely.

BACKGROUND OF THE INVENTION

1. Field of the Invention

The present invention relates to a head for an ink-jet printer (hereinafter, "ink-jet printer head"), and an ink-jet printer 2. Description of the Related Art An ink-jet printer which records images on a recording medium by jetting an ink, including a cavity unit which includes a plurality of nozzle holes jetting the ink, a plurality of pressure chambers communicating with the nozzle holes respectively, and a manifold which stores temporarily the ink to be supplied to the pressure chambers, and an energy imparting unit which imparts a jetting energy to the ink in the pressure chambers, has been hitherto known.

In a recording head used in such an ink-jet printer, in recent years, a high-speed printing and an improvement in an image quality have been sought. In view of this, a reduction in size of a head, and a reduction in weight have been carried out. Therefore, a length of the pressure chambers is shortened (reduced) and an amount of liquid droplets discharged at a time from the head is decreased, and the number of nozzles are increased. It makes possible to perform the high-speed printing.

In this case, even when the length of the pressure chambers is reduced, a resistance of (in) throttle portions which are communicating channels communicating between the pressure chambers and the manifold, is to be increased. When the resistance of the throttle portions is too small, there is a possibility that a pressure wave generated in the pressure chambers is propagated to adjacent pressure chambers through the manifold. Due to the propagation of the pressure wave to the adjacent pressure chambers, an amount of ink and/or a speed of a flow of ink which is supplied from the manifold to the pressure chambers after the jetting of ink becomes too high, and there is a possibility that a meniscus of the ink (an ink surface in the nozzle) cannot be maintained to be stable.

As a mechanism for adjusting the resistance of the throttle portions, adjusting the resistance of the throttles by providing thin and shallow grooves in a plate in a cavity unit has been known (refer to Japanese Patent Application Laid-open No. 2001-30483, for example).

Moreover, adjusting the resistance of the throttle portions by increasing a length of the throttle portions by making the throttle portions inclined (oblique) as it will be shown below, can be taken into consideration.

For example, a cavity unit 101 shown in FIG. 15 to FIG. 17 includes a stacked body 102 of a plurality of plates having a top plate arranged on an upper side of the stacked body 102, and a plate assembly 106 which is arranged on a lower side of the stacked body 102, and formed by attaching a nozzle plate 104 and a space plate 105, and these plates are attached integrally. The stacked body 102 includes a cavity plate 102A, a base plate 102B, an aperture plate 102C, two manifold plates 102D and 102E, and a damper plate 102F in this order from an upper side, and these plates are stacked (superimposed) and joined by a metal diffusion bonding. In such cavity unit 101, it can be taken into consideration to form communicating channels 201 (throttle portions) communicating with pressure chambers 102Aa of the cavity plate 102A, and manifolds 102Da and 102Ea of the manifold plates 102D and 102E as recesses which incline with respect to a longitudinal direction of the pressure chambers and which extend beyond the adjacent pressure chambers on an upper surface of the aperture plate 102 by a method such as half etching.

SUMMARY OF THE INVENTION

However, as it has been described in Japanese Patent Application Laid-open No. 2001-30483, even if it is possible to arrange each of the communicating channels upon making the communicating channel long, when a design of a length of the throttle portions is required to be changed due to a head with a different specification of ink constituent, and a multi-color head, it is difficult to change a design of the length of the throttle portions.

Moreover, as shown in FIG. 15, when the inclined throttle portions are formed, the throttle portions pass through lower portions of pressure chambers of the adjacent channels, and a cross-talk of the adjacent channels due to a pressure wave becomes a problem.

An object of the present invention is to provide an ink-jet printer head including communicating channels (throttle portions) communicating between pressure chambers having a throttle resistance of a sufficient magnitude, and a manifold, in which it is easy to change a design of various specifications and to change a design of a channel length of the communicating channels, without an effect of cross-talk with the other communicating channels.

According to a first aspect of the present invention, there is provided a head which jets an ink on a recording medium, the head including:

a cavity unit in which a plurality of nozzle holes; a plurality of pressure chambers arranged on a plane which communicate with the nozzle holes respectively; a manifold which stores the ink to be supplied to the pressure chambers; communication channels in each of which a first communicating portion communicating with one of the pressure chambers, a second communicating portion communicating with the manifold, and a turning portion between the first communicating portion and the second communicating portion are formed; and an energy imparting mechanism which imparts a jetting energy to the ink in the pressure chambers. Here, "the energy imparting mechanism which imparts the jetting energy to the ink in the pressure chambers" also includes apart from a piezoelectric type, a bubble-jet (registered trademark) type which jets the ink by expanding by heating the ink in the pressure chambers.

When such an arrangement is made, since the first communicating portion having an opening in each of the pressure chambers is formed at one end of each of the communicating channels (throttle portions) making one of the pressure chambers communicate with the manifold, the second communicating portion having an opening in the manifold is formed at the other end of each of the communicating channels, and has a portion extending in a direction opposite to the first communicating portion, and a portion returning toward the first communicating portion, it is easy to change a design of a length of the communicating channel, and to change a design of various specifications. Moreover, since each of the communicating channels is extended toward the direction opposite to the first communicating portion, and formed so as to return toward the first communication portion, it is possible to realize compact communicating channels having a long channel length. Moreover, this advantages for avoiding a cross-talk when an area of overlapping in a plan view of each of the communicating channels with the other pressure chambers, is small. By providing a long communicating channel between the pressure chambers and the manifold, the throttle resistance (channel resistance) is increased, and it is possible to prevent the pressure wave from being propagated to the manifold, and to prevent the pressure wave from being propagated back into the pressure chamber from the other pressure chambers via the manifold. Furthermore, after the ink is discharged, with the decrease in a pressure in the pressure chambers, the ink is supplied from the manifold to the pressure chambers. However, since the ink is supplied through the communicating channels having a small conductance, sudden inflow of a large amount of ink into the pressure chambers is prevented, and it is possible to maintain a meniscus of the ink (ink surface in the nozzle) to be stable. In other words, by forming the long communicating channels, it is possible to adjust the ink supplied to the pressure chambers, or to adjust a so-called amount of refilling and/or speed of the flow of refilling of the ink.

In the head of the present invention, the communication channels may overlap with the pressure chambers which communicates with the communication channels, respectively, or the communication channels may overlap entirely with the pressure chambers which communicates with the communication channels, respectively.

When such an arrangement is made, since the communicating channels are provided with a positional relationship overlapping with the pressure chambers being communicated with in a plan view, the effect of cross-talk from the communicating channels to the adjacent pressure chambers is reduced. When the communicating channels overlaps entirely with the pressure chambers being communicated with, the effect of cross-talk from the communicating channels to the adjacent pressure chambers is reduced.

In the head of the present invention, the pressure chambers may have an elongated shape; and each of the communication channels may have a first straight portion which is extended in a longitudinal direction of one of the pressure chambers, from the first communicating portion, a second straight portion which is extended parallel to the first straight portion from the second communicating portion; and a bent portion which communicates a front end of the first straight portion and a front end of the second straight portion.

When such an arrangement is made, by combining the two straight portions and the bent portion, it is possible to form easily each of the communicating channels which allow the pressure chambers and the manifold to communicate, and by allowing each of the communicating channels to have the bent portion, it is possible to form long communicating channels even in a narrow area.

In the head of the present invention, the cavity unit may be constructed of a stack formed by stacking a plurality of plates including an upper side plate in which the pressure chambers are formed, a lower side plate in which the second communicating portion of each of the communication channels is formed, and an intermediate plate provided between the upper side plate and the lower side plate and in which the first communicating portion of each of the communication channels is formed; and each of the communication channels may be a recess formed in a plate forming the stack.

When such an arrangement is made, it is possible to form each of the communicating channels easily by a method such as an etching, and to form long communicating channels by forming the communicating channels in the plurality of plates.

In the head of the present invention, the communication channels may be formed in a lower surface of the intermediate plate, or the communication channels may be formed in an upper surface of the lower side plate. In any of these cases, it is possible to form long communicating channels by making recesses of an appropriate shape, without increasing the number of components (number of plates), and it is also possible to change easily a design of the length of the communicating channels.

In the head of the present invention, the communication channels may be formed in a same surface parallel to the plane. In this case, it is possible to form long communicating channels in one plate for example, and to reduce the number of components.

In the head of the present invention, the bent portion of each of the communication channels may be extended in a direction different from a plane direction of the plane. Moreover, the first straight portion and the second straight portion of each of the communication channels may be formed on planes respectively, the planes being different in a direction of a thickness of the plates. In any of the cases, it is possible to form long communicating channels in a narrow range, in a plan view.

In the head of the present invention, the communication channels may be arranged such that a communication channel among the communication channels does not overlap with a pressure chamber, among the pressure chambers, which is adjacent to another pressure chamber communicating with the communication channel. In this case, it is possible to reduce the cross-talk between adjacent pressure chambers.

In the head of the present invention, a length of each of the communication channels may be greater than a direct distance between the first communicating portion and the second communicating portion. In this case, since it is possible to increase the length of the communicating channels, a throttle resistance of a sufficient magnitude can be ensured.

In the head of the present invention, the bent portion may be a U-turn channel. In this case, it is possible to increase the length of the communicating channels because of the U-turn channel.

According to a second aspect of the present invention there is provided an ink-jet printer which performs recording on a recording medium by jetting an ink on the recording medium, the ink-jet printer including:

a head including a cavity unit formed with a plurality of nozzle holes, a plurality of pressure chambers arranged on a plane and communicating with the nozzle holes respectively, a manifold which stores the ink to be supplied to the pressure chambers, a communication channels in each of which a first communicating portion communicating with one of the pressure chambers, a second communicating portion communicating with the manifold, and a turning portion between the first communicating portion and the second communicating portion are formed; and an energy imparting mechanism which imparts a jetting energy to the ink in the pressure chambers;

a carriage which is movable while supporting the head; and a control mechanism which is connected to the head and the carriage, and which supplies a predetermined operation signal to the energy imparting mechanism, and supplies a control signal for controlling a movement of the carriage to the carriage.

According to the second aspect of the present invention, since an amount of refilling and/or a speed of a flow of refilling of the ink is adjusted by forming long communicating channels, it is possible to maintain to be stable a meniscus of the ink, and to maintain a favorable printing quality of the ink-jet printer.

Since the ink-jet printer head and ink-jet printer are structured as described above, in the present invention, it is possible to change easily a design of the channel length of the communicating channels, and a design of various specifications, and it is possible to avoid an effect (cross-talk) between the communicating channels which communicate the pressure chambers and the manifold, and other pressure chambers.

DETAILED DESCRIPTION OF THE PREFERRED EMBODIMENTS

An embodiment of the present invention will be described below in referring to the diagrams.

Figure 1A:
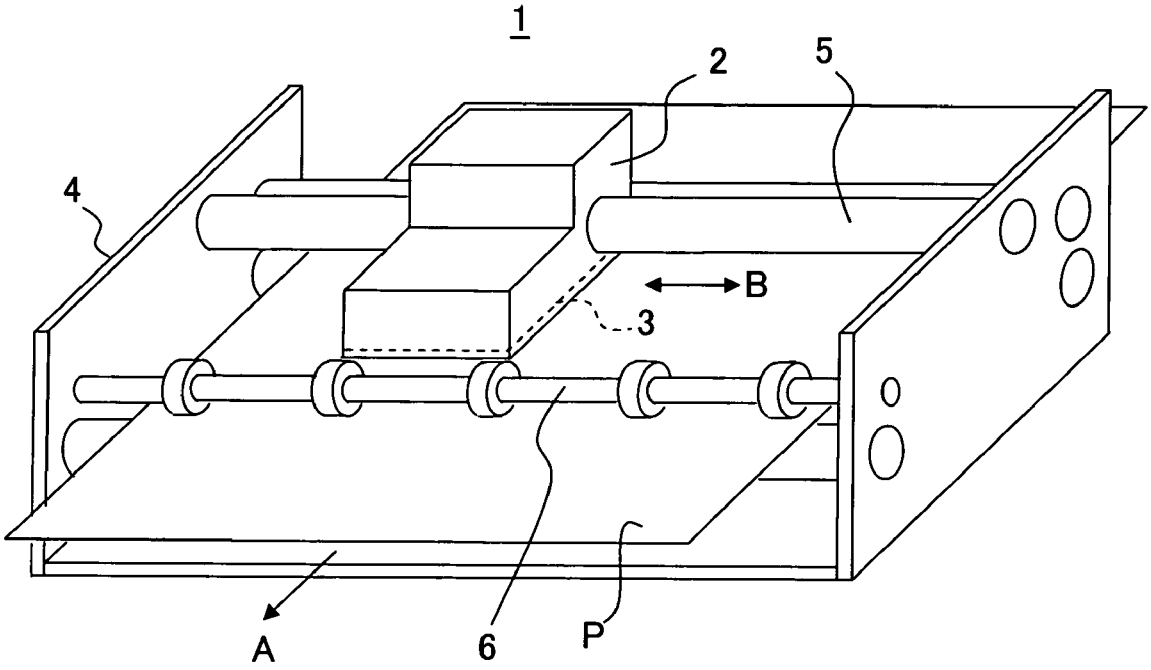
FIG. 1A is a schematic structural view showing an ink-jet printer according to the present invention.
Figure 1B:
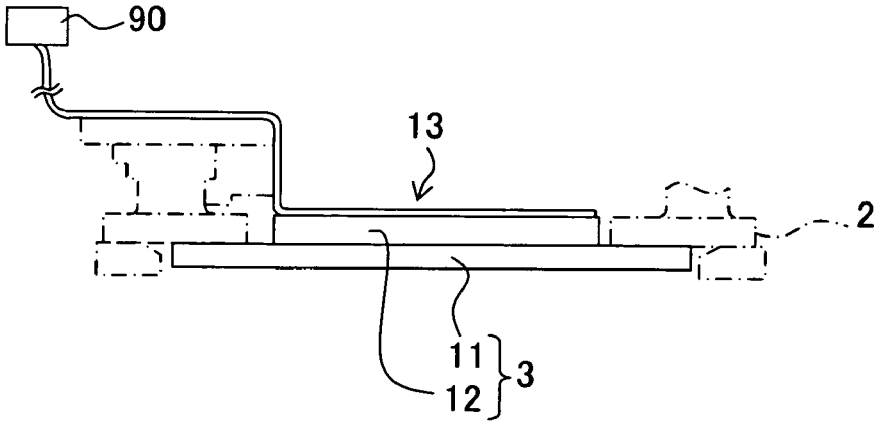
FIG. 1B is a diagram describing a relation of a cavity unit, an actuator unit, and a flexible flat cable.

FIG. 1A is a schematic structural view showing an ink-jet printer according to the present invention, and FIG. 1B is a diagram describing a relation of a cavity unit, an actuator unit, and a flexile flat cable (COP).

As shown in FIG. 1A, an ink-jet printer 1 according to the present invention includes a printer frame 4, platen rollers and discharging rollers 6, a guide plate (not shown in the diagram) and a carriage shaft 5 provided to the printer frame 4, a carriage 2 on which an ink cartridge (not shown in the diagram) is mounted, which is supported by the carriage shaft 5 and the guide plate, and which performs a reciprocating motion in a direction B orthogonal to a transporting direction A of a recording paper P, and an ink-jet printer head 3 (hereinafter called as a "head") which is provided on a lower surface of the carriage 2, and which records characters etc. on the recording paper P (recording medium).

The recording paper P carried in the transporting direction A from a paper feeding section which is not shown in the diagram is introduced between the platen rollers (not shown in the diagram) and the head 3. A predetermined recording is performed by the ink which is jetted from the head 3 toward the recording paper P, and then the recording paper P is discharged by the discharging rollers 6.

Figure 2A:
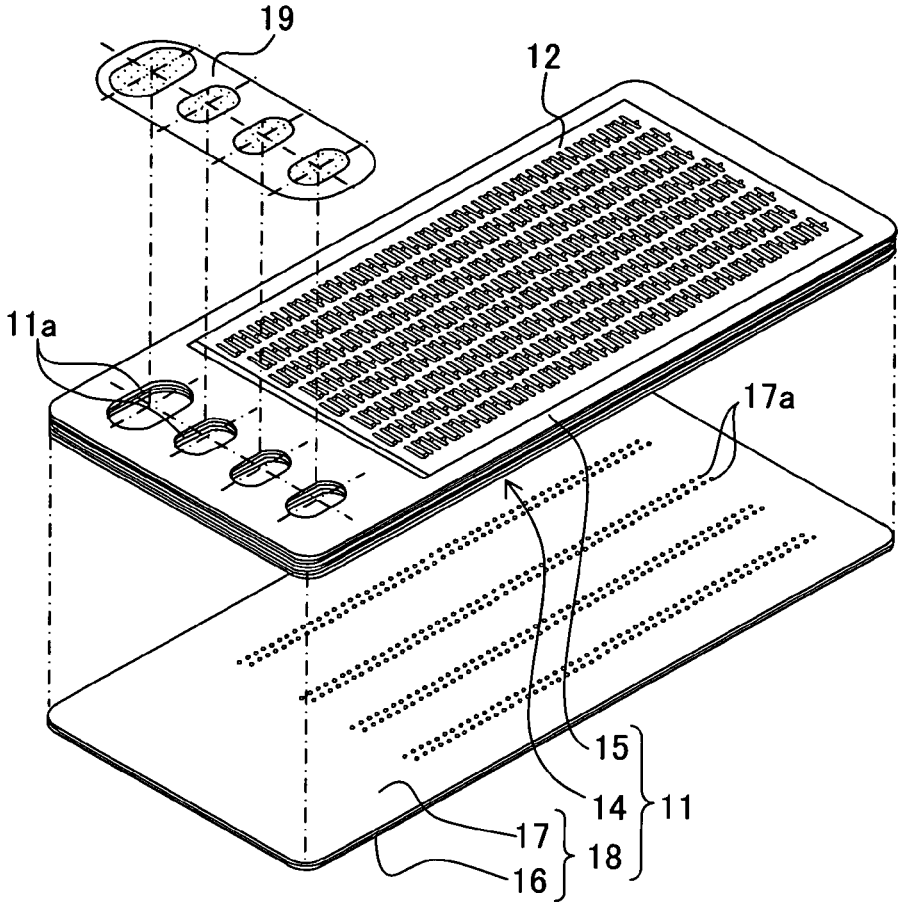
FIG. 2A is a perspective view showing a state when the actuator unit is stuck on an upper side of the cavity unit.
Figure 2B:
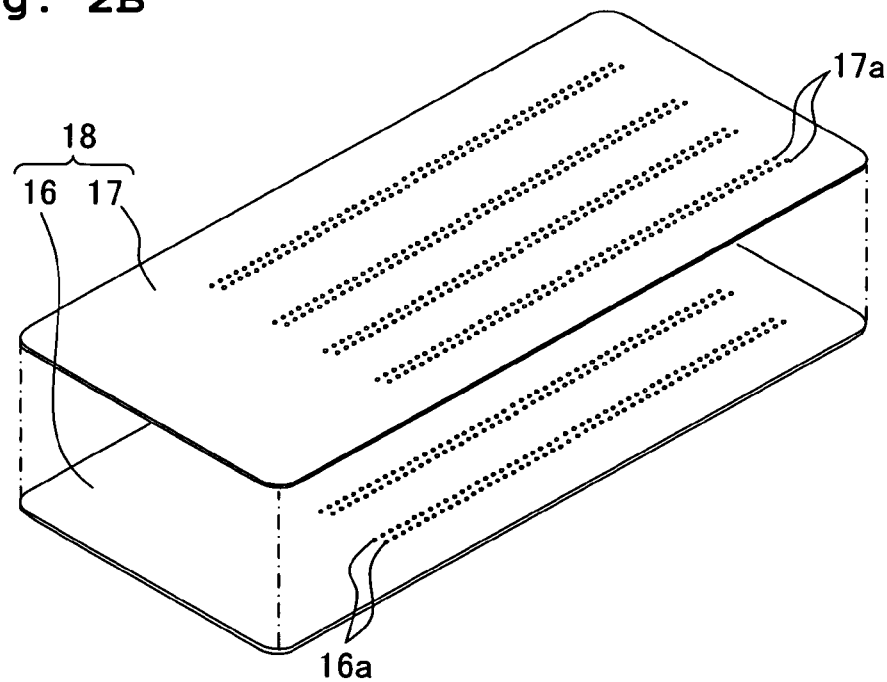
FIG. 2B is a perspective view of a plate assembly.

Moreover, as shown in FIG. 1B and FIG. 2, the head 3 includes a cavity unit 11 and an actuator unit 12 in order from a lower side, and further includes a flexible cable 13 on an upper surface of the actuator unit 12, having signal wires which supply a driving signal. One end of the flexible cable 13 is connected to the actuator unit 12, and the other end of the flexible cable 13 is connected to a control unit 90. The control unit 90 is also connected to the carriage 2 by wires not shown in the diagram, and supplies a control signal for controlling the movement of the carriage 2 and a voltage signal which supplies a predetermined voltage to individual surface electrodes which will be described later, to the carriage 2 and the head 3 respectively.

The cavity unit 12 includes a stacked body 14, a top plate 15, and a plate assembly 18. The stacked body 14 is made of a plurality of plates. The top plate 15 is arranged on an upper surface of the stacked body 14. The plate assembly 18 is arranged on a lower surface of the stacked body 14, and is formed by sticking a nozzle plate 16 in which nozzle holes 16*a* are formed, and a spacer plate 17 in which through holes 17*a* corresponding to the nozzle holes 16*a* are formed. The stacked body 14, the top plate 15, and the plate assembly 18 are attached integrally. The actuator unit 12 is arranged on an upper surface of the top plate 15. Moreover, as shown in FIG. 2A, filters 19 for trapping dust etc. in the ink, is provided at openings 11*a* of the cavity unit 11. The nozzle plate 16 is a plate made of a synthetic resin (such as polyimide) in which one nozzle 16*a* is formed corresponding to each of the pressure chambers 14A formed in a cavity plate 14A (which forms the stacked body 14) which will be described later. The nozzle plate 16 may be a metallic plate.

Figure 3:
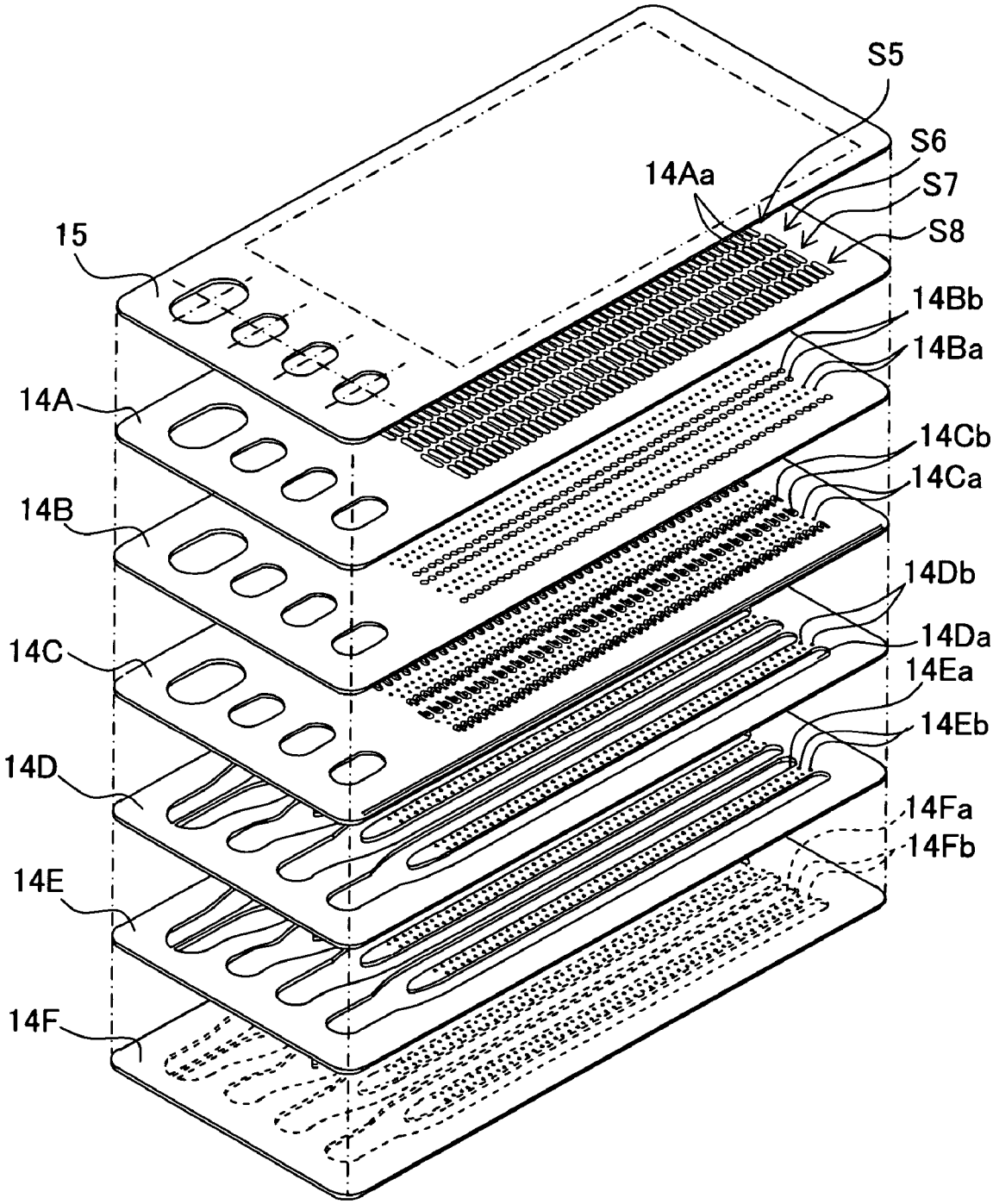
FIG. 3 is diagram showing the cavity plate disassembled to each plate which is a component of the cavity plate, together with a top plate.

As shown in FIG. 3, the stacked body 14 includes the cavity plate 14A, a base plate 14B, an aperture plate 14C, two manifold plates 14D and 14E, and a damper plate 14F, and these plates are stacked and joined by a metal diffusion bonding (joining). These six plates 14A to 14F are stacked upon adjusting mutual positions such that individual ink channels corresponding to the nozzle holes 16*a* are formed. Here, a plurality of pressure chambers 14Aa are formed in the metallic cavity plate 14A. In the metallic base plate 14B, communicating holes 14Ba (first communicating portions) which makes manifolds 14Da and 14Ea (common ink chambers) communicate with the pressure chambers 14Aa, and communicating holes 14Bb which make the pressure chambers 14Aa communicate with the nozzle holes 16*a* are formed. On an upper surface of the aperture plate 14C, communicating channels 21 which make the pressure chambers 14Aa communicate with each of the manifold 14Da and 14Ea are formed as grooves (recess communicating channels), in the aperture plate 14C, communicating holes 14Ca (second communicating portions) which make the manifolds 14Da and 14Ea communicate with the pressure chambers 14Aa, and communicating holes 14Cb which make the pressure chambers 14Aa communicate with the nozzle holes 16*a* are formed. In the metallic manifold plates 14D and 14E, communicating holes 14Db and 14Eb which make the manifold 14Da and 14Ea, the pressure chambers 14Aa, and the nozzle holes 16*a* communicate with each other are formed. On a lower surface of the metallic damper plate 14F, a damper chambers 14Fa is formed as recesses, and in the damper plate 14F, communicating holes 14Fb which make the pressure chambers 14Aa communicate with the nozzle holes 16*a*.

The actuator unit 40 includes internal common electrodes formed on the top plate 15, corresponding to each of the pressure chambers 14Aa, piezoelectric sheets formed on the internal common electrodes, and surface electrodes (individual surface electrodes) formed on the piezoelectric sheets, corresponding to the pressure chambers 14Aa, respectively. The top plate 15 functions as a vibration plate, and is deformed to form a projection toward the pressure chambers 14Aa, accompanied by a deformation of the piezoelectric sheets. The piezoelectric sheets are made of a lead zirconate titanate (PZT) based ceramics material which is ferroelectric, and is polarized in a direction of thickness of the piezoelectric sheets. The surface electrodes are made of Ag—Pd based metallic material, and are connected to a driver IC which is not shown in the diagram, by signal wires of the flexible cable 13 by which a driving signal is supplied. On the other hand, the internal common electrodes are kept at a ground electric potential all the time. Consequently, by letting an electric potential of the surface electrodes to be different from the ground electric potential (such as electric potential higher than the ground electric potential for example), an electric field is applied to the piezoelectric sheets in the direction in which the piezoelectric sheets are polarized. Portions of the piezoelectric sheets to which the electric field is applied are contracted in a direction orthogonal to the direction of polarization due to a piezoelectric transverse effect, as an active layer. On the other hand, since the top plate 15 is not contracted spontaneously, there is a difference in a distortion in a direction orthogonal to the direction of polarization between the piezoelectric sheets which are an upper layer, and the top plate 15 which is a lower layer. Since the top plate 15 is fixed to the cavity plate 14A, the piezoelectric sheets and the top plate 15 are deformed (unimorph deformation) to form a projection toward the pressure chambers 14Aa. Therefore, a volume of the pressure chambers 14Aa is decreased and there is a rise in a pressure on the ink in the pressure chambers 14Aa. When there is a rise in the pressure on the ink, the ink is discharged from the nozzle holes 16*a*. Thereafter, when the surface electrodes are returned to an electric potential same as the electric potential of the internal common electrodes, the piezoelectric sheets and the top plate 15 regain an original shape, and the volume of the pressure chambers 14Aa returns to the original volume. Therefore, the pressure in the pressure chambers 14Aa is decreased, and the ink is sucked from the manifolds 14Da and 14Ea.

As it is described above, in this embodiment, since the top plate 15 is provided as the vibration plate, on an upper side of the cavity plate 11, it is possible to realize an excellent jetting efficiency due to the unimorph deformation.

Thus, in the cavity unit 11, the nozzle holes 16*a*, the pressure chambers 14Aa communicating with the nozzle holes 16*a* respectively, and the manifolds 14Da and 14Ea which stores temporarily the ink to be supplied to the pressure chambers 14Aa are formed. On the other hand, the actuator unit 12 has the individual surface electrodes corresponding to the pressure chambers 14Aa respectively, and it is possible to make the ink jet from the nozzle holes 16*a* by changing the volume of the pressure chambers by supplying the driving signal to the individual surface electrodes.

Figure 4:
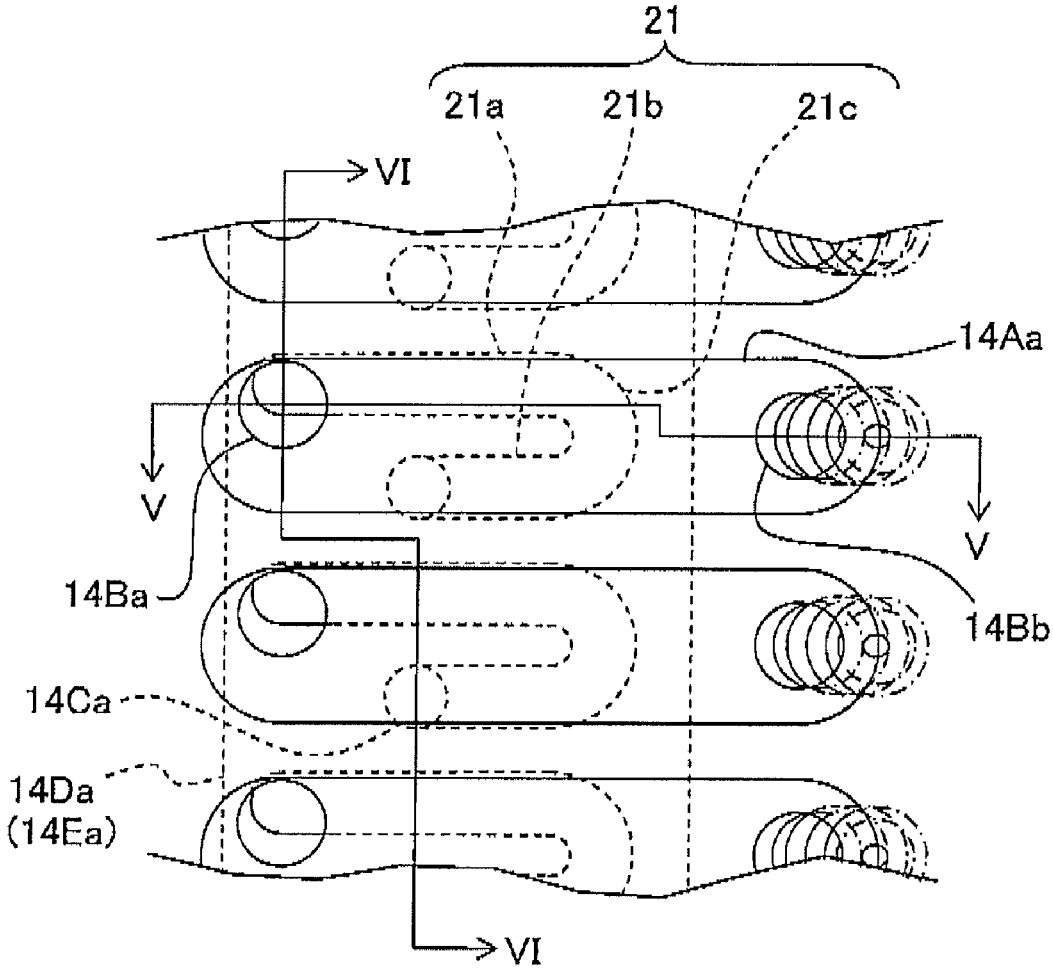
FIG. 4 is a plan view of main components in FIG. 3, excluding the top plate.

Next, the communicating channels 21 which make the pressure chambers 14Aa communicate with the manifolds 14Da and 14Ea will be described in detail with reference to FIG. 4 to FIG. 6.

The communicating channels 21 which make the pressure chambers 14Aa communicate with the manifolds 14Da and 14Ea, include first straight (line) portions 21*a*, each of which one end communicates with one of the communicating hole 14Ba, and which are extended in a longitudinal direction of the pressure chambers 14Aa, second straight (line) portions 21*b*, each of which one end communicates with one of the communicating holes 14Ca, and which are extended parallel to the first straight portions 21*a*, and bent portions (turning portions) 21*c* which bent gently, when viewed from a direction orthogonal with respect to a plane of each plate 14A to 14F, and 15. A channel length of the first straight portions 21*a* is longer than a channel length of the second straight portions 21*b*, and a width of the first straight portions 21*a* and the second straight portions 21*b* is about ⅓ of a width of the pressure chambers 14Aa. For example, when the width of the pressure chambers 14Aa is 270 μm, a width of the communicating channels 21 is 90 μm, and when the width of the pressure chambers 14Aa is 250 μm, the width of the communicating channels 21 is 80 μm. Here, a plate thickness is 50 μm, and a groove depth is 30 μm.

Figure 5:
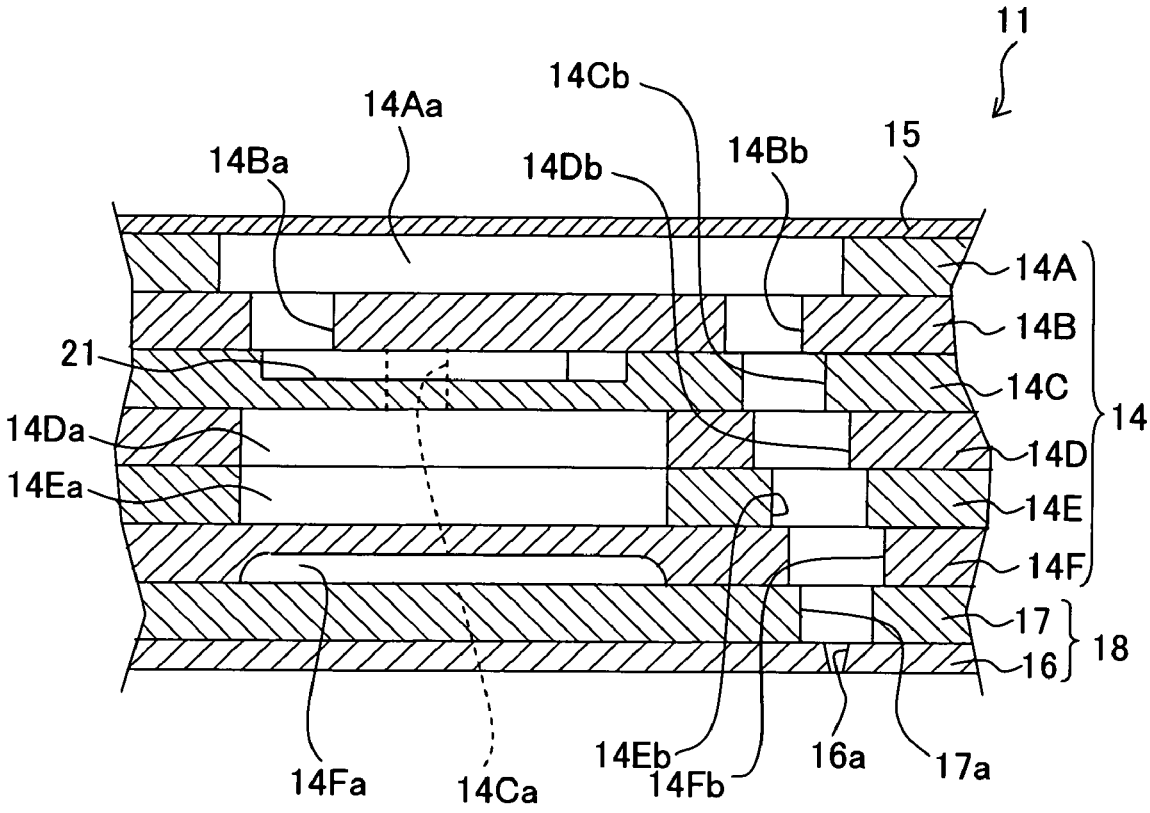
FIG. 5 is a cross-sectional view taken along a line V-V shown in FIG. 4.
Figure 6:
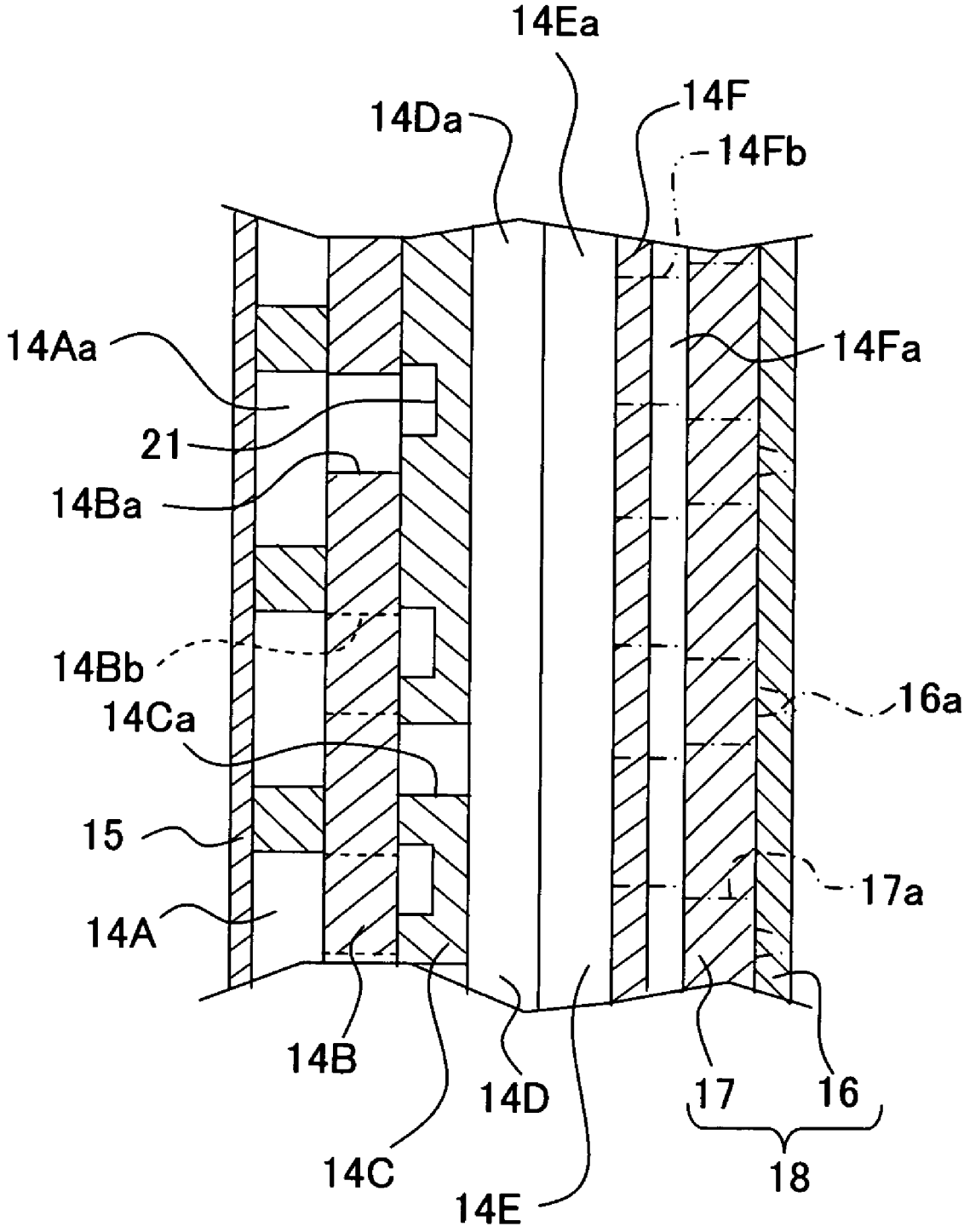
FIG. 6 is a cross-sectional view taken along a line VI-VI shown in FIG. 4.
Figure 7:
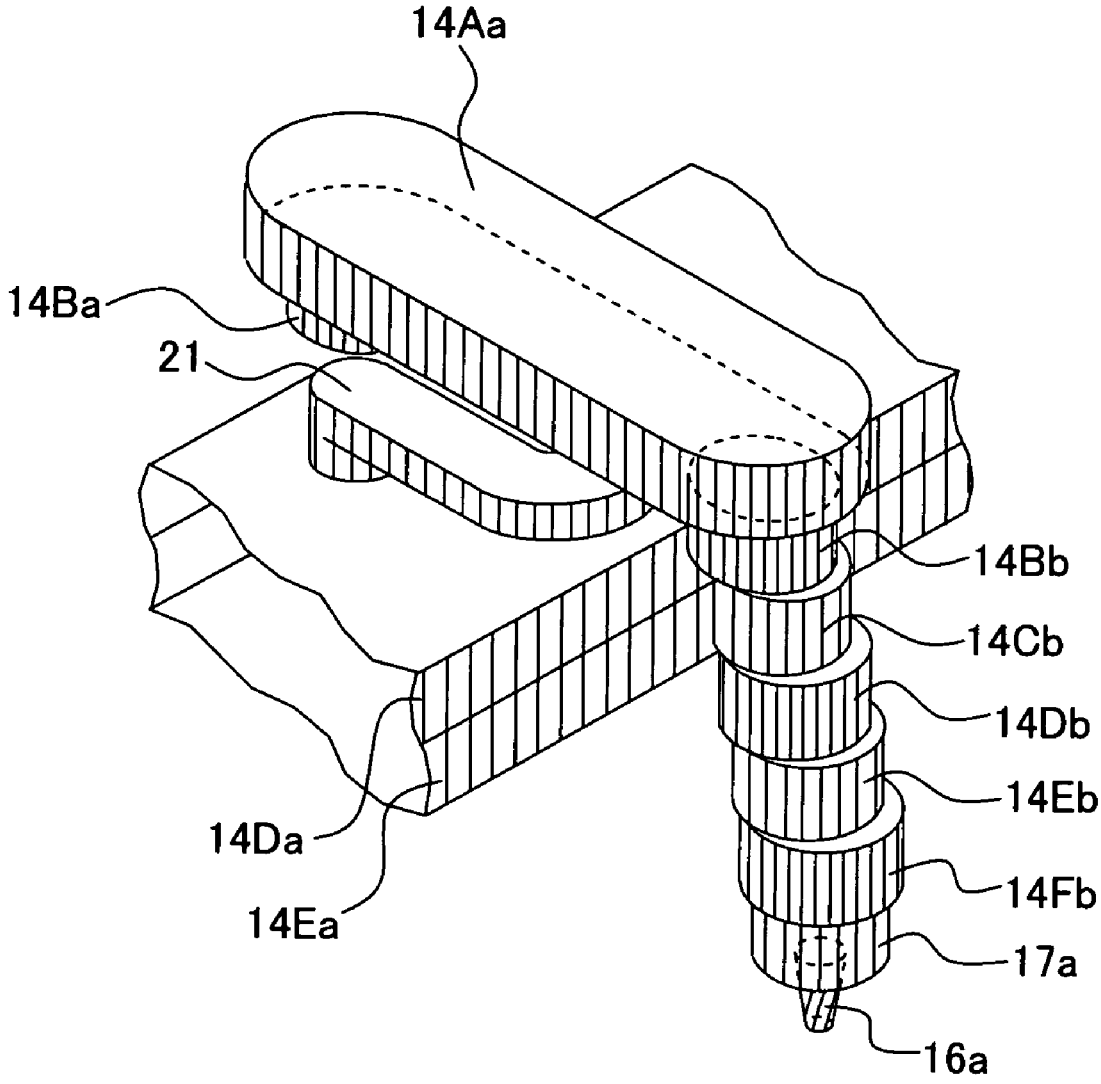
FIG. 7 is a perspective view showing a communicating channel.

As shown in FIG. 5, the communicating channels 21 are formed as grooves on the upper surface of the aperture plate 14C (lower side plate). As it is described above, the communicating channels 21, include the first straight portions 21*a* which communicate with the communicating holes 14Ba opening in the pressure chambers 14Aa of the cavity plate 14A, and which are extended from the communicating holes 14Ba toward the communicating holes 14Cb, the bent portions 21*c* which communicate with the first straight portions 21*a*, and which are U-turn channels returning toward the communicating holes 14Ba, and the second straight portions 21*b* which communicate with the communicating holes 14Ca. Here, as shown in FIG. 4 and FIG. 7, the communicating channels 21 are formed to have a shape roughly as of an English alphabet U, in a plan view. Moreover, since the communicating channels 21 are formed to be accommodated in areas overlapping with the pressure chambers 14Aa in a plan view, the communicating channels 21 do not overlap with adjacent pressure chambers 14Aa, and there is no cross-talk at all with the adjacent pressure chambers 14Aa. The communicating channels 21 are formed by a method such as a half etching.

For forming such communicating channels 21 easily, the cavity unit 11 includes the stacked body 14, and an upper portion of the stacked plates which includes the cavity plate 14 (upper side plate), in which the pressure chambers 14Aa as through holes are formed, the aperture plate 14C (lower side plate) in which the communicating holes 14Ca as the second communicating portions are formed, and the base plate 14B (intermediate plate) which is arranged between the cavity plate 14A and the aperture plate 14C, and in which the communicating holes 14Ba as the first communicating portions are formed.

Here, since each of the communicating channels 21 have the two straight portions 21*a* and 21*b*, and the bent portions 21*c*, only by changing positions at which the bent portions 21*c* are provided, it is possible to change a length of the straight portions 21*a* and 21*b*, and to change easily the length of the communicating channels 21. Moreover, since each of the communicating channels 21 overlaps entirely with the corresponding pressure chamber 14Aa in a plan view, there is no possibility of the cross-talk between the communicating channels 21 and the adjacent pressure chambers 14Aa.

Figure 8:
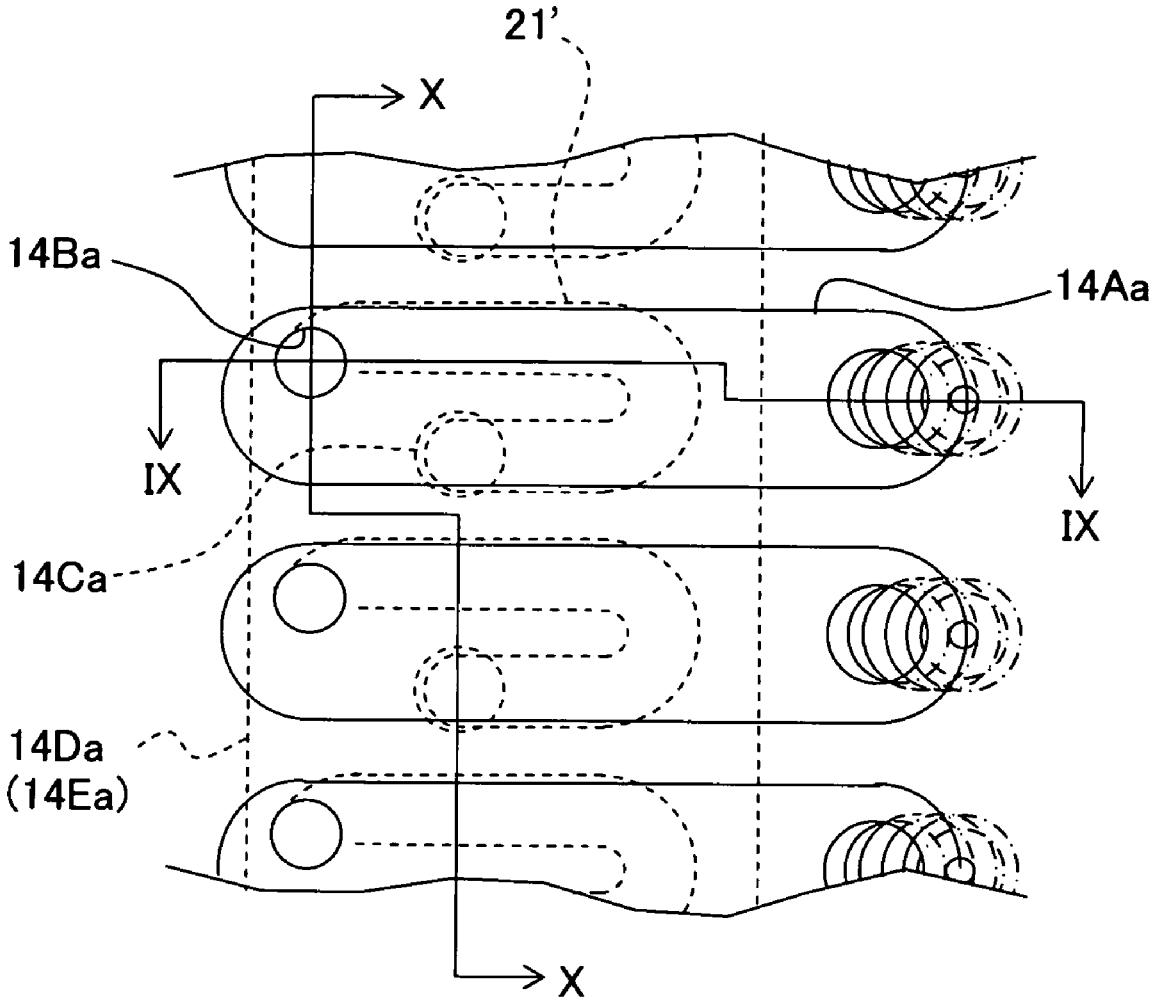
FIG. 8 is a diagram corresponding to FIG. 4 of a cavity plate in other embodiment.
Figure 9:
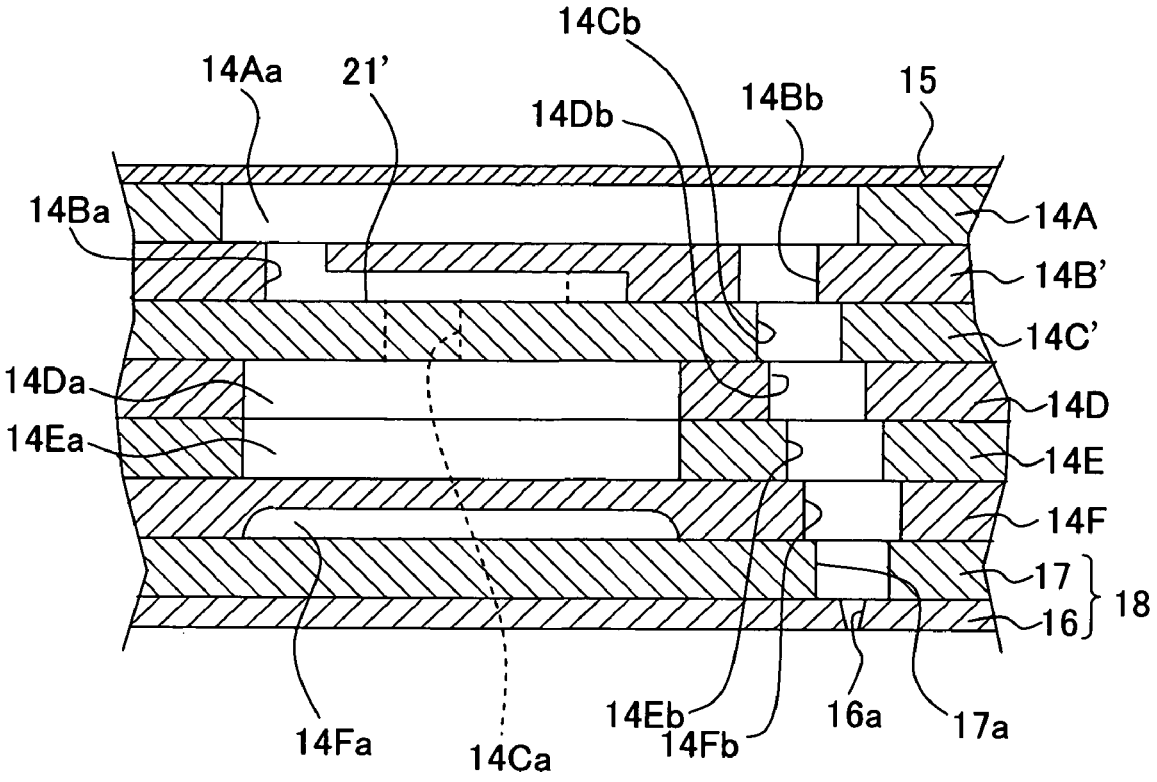
FIG. 9 is a cross-sectional view taken along a line IX-IX shown in FIG. 8.
Figure 10:
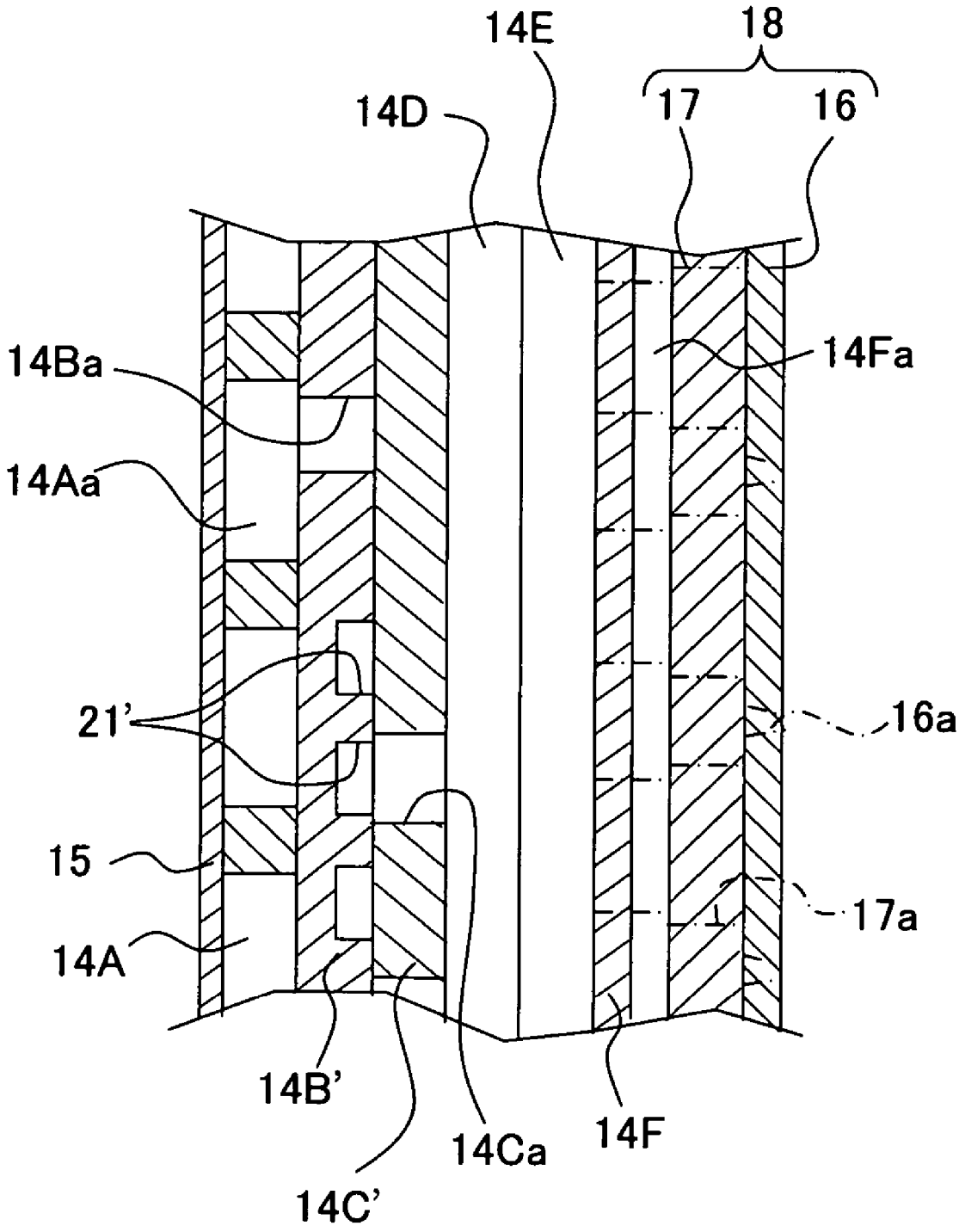
FIG. 10 is a cross-sectional view taken along a line X-X shown in FIG. 9.

Moreover, as shown in FIG. 8 to FIG. 10, it is also possible to form communicating channels 21'. In this case, a cavity plate 11' includes a stacked body 14', and the stacked body 14' includes on an upper side surface, a cavity plate 14 (upper side plate) in which the pressure chambers 14Aa as through holes are formed, an aperture plate 14C' (lower side plate) in which the communicating holes 14Ca as the second communicating portions are formed, and a base plate 14B' (intermediate plate) which is arranged between the cavity plate 41 and the aperture plate 14C', and in which the communicating holes 14Ba are formed. Moreover, the communicating channels 21' are formed as grooves in a lower surface side of the base plate 14B', and one end (down stream end) of each of the communicating channels 21' communicates with the communicating hole 14Ba which is the first communicating portion, and the other end (upstream end) communicates with the communicating hole 14Ca.

Even in this case, it is possible to change easily a design of a length of the communicating channel 21', and there is no possibility of the cross-talk between the communicating channels 21' and the adjacent pressure chambers 14Aa.

The present invention is not restricted to the embodiment described above, and it is possible to make modifications as shown below.

First Modified Embodiment

Figure 11:
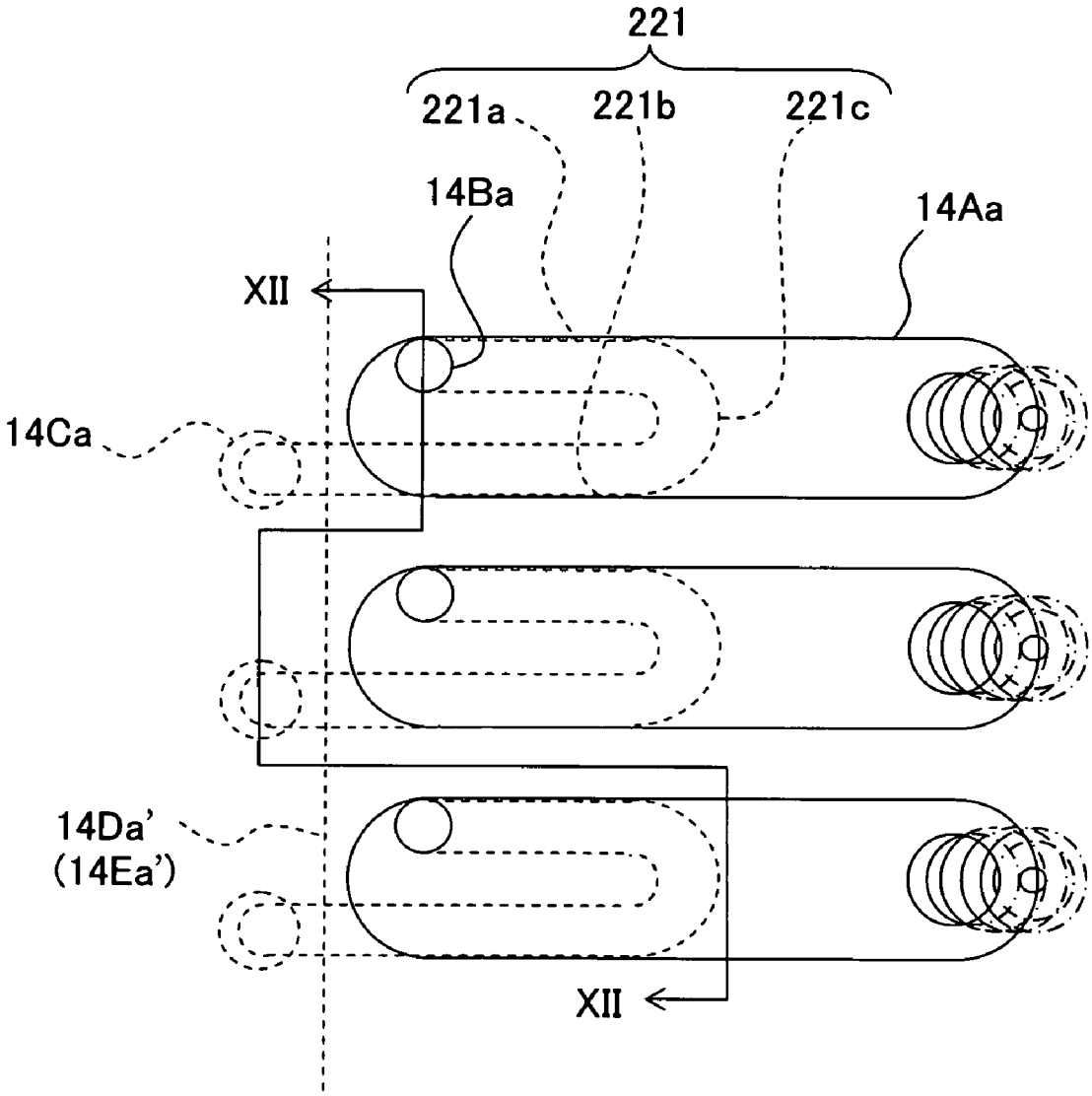
FIG. 11 is a diagram corresponding to FIG. 4 of a cavity plate in a first modified embodiment.
Figure 12:
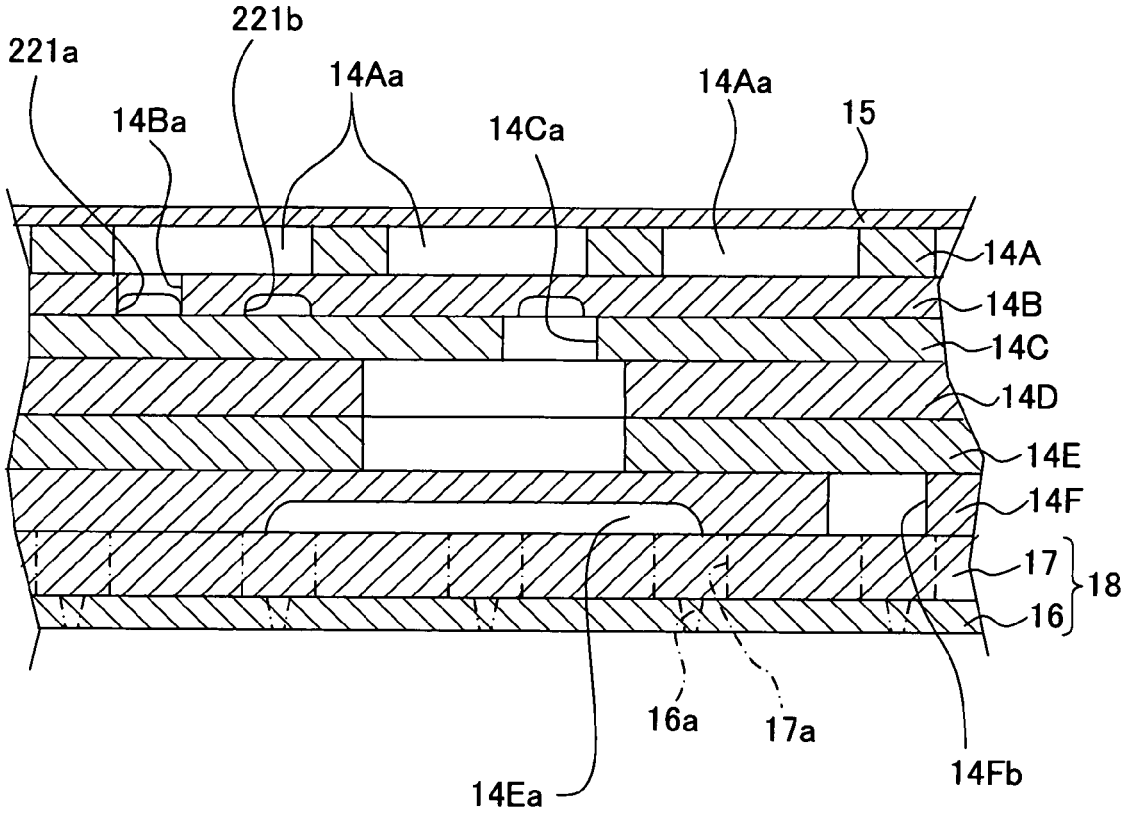
FIG. 12 is a cross-sectional view taken along a line XII-XII shown in FIG. 11.

In the embodiment described above, in a plan view, the pressure chambers 14Aa and the manifolds 14Da and 14Ea overlap. However, the present invention is not restricted to such a structure, and as shown in FIG. 11 and FIG. 12, the manifolds 14Da' and 14Ea' may be formed at positions shifted in the longitudinal direction of the pressure chambers 14Aa such that the manifolds 14Da' and 14Ea' do not overlap with the pressure chambers 14Aa. In other words, communicating channels 221 include first straight portions 221*a*, each of which communicates at one end with the communicating hole 14Ba, and which are extended in the longitudinal direction of the pressure chambers 14Aa, second straight portions 221*b*, each of which communicates at one end with the communicating hole 14Ca, which are extended parallel to the first straight (line) portions 221*a*, and bent portions 221*c* which communicates with the other ends of the first straight portions 221*a* and the other ends of the second straight portions 221*b*, and which are bent gently. Moreover, a side of the second straight portions 221*b* communicating with the communicating holes 14Ca are extended further beyond an end portions of the pressure chambers 14Aa in a plan view, and communicate with the manifolds 14Da' and 14Ea' outside areas overlapping with the pressure chambers 14Aa.

When such manifolds 14Da' and 14Ea' are arranged with respect to the pressure chambers 14Aa, at positions shifted in the longitudinal direction of the pressure chambers 14Aa, it is possible to omit the aperture plate 14C, and to form openings at an upstream end of the communicating channels formed in the base plate 14B, which open in the manifolds 14Da and 14Ea.

Second Modified Embodiment

In the embodiment described above, the entire communicating channels 21 overlap with the pressure chambers 14Aa. However, the present invention is not restricted to such a structure, and at least a part of the communicating channels 21 may overlap with the pressure chambers 14A. This is because, when the communicating channels 21 overlap partially, the cross-talk can be avoided to some extent.

Third Modified Embodiment

Figure 13:
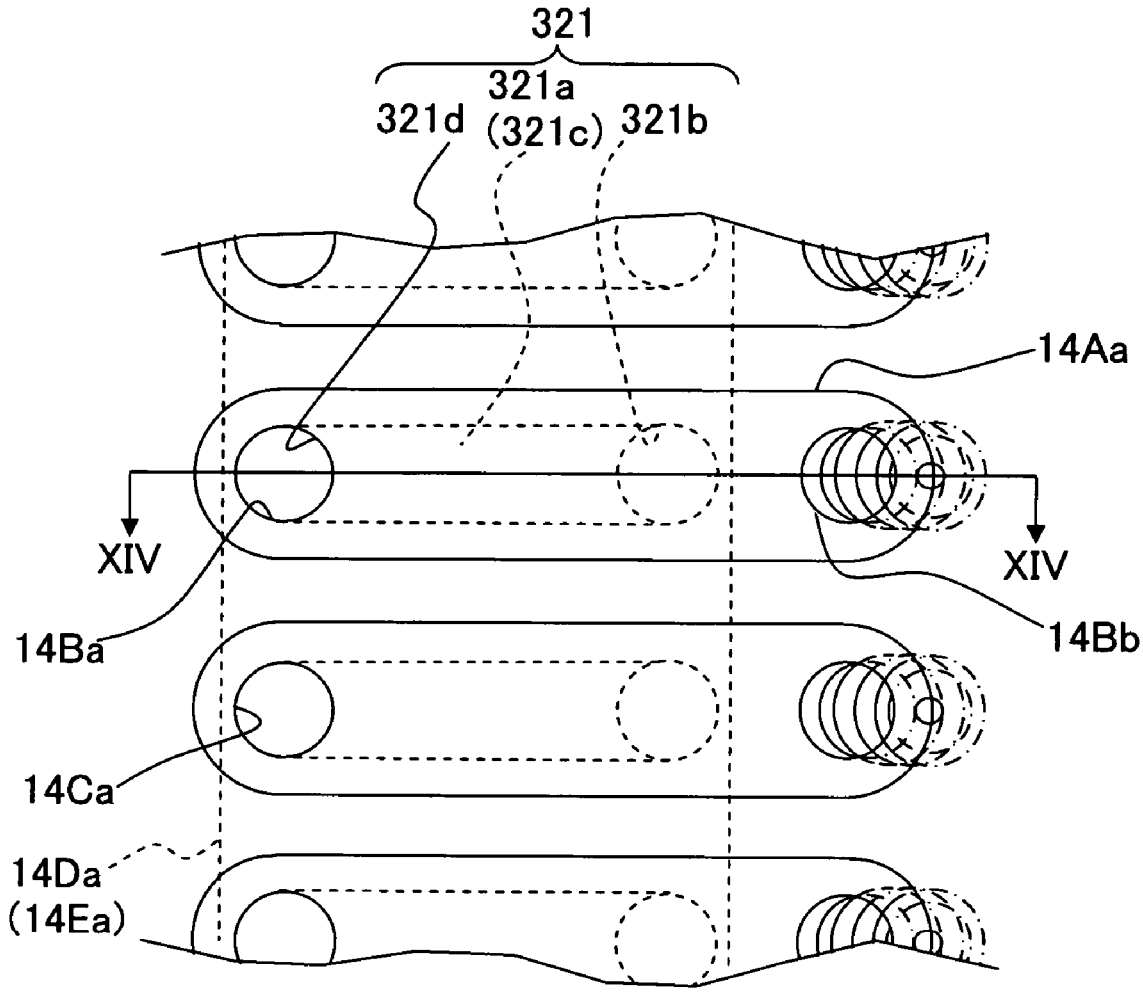
FIG. 13 is a diagram corresponding to FIG. 4 of a cavity plate in a third modified embodiment.
Figure 14:
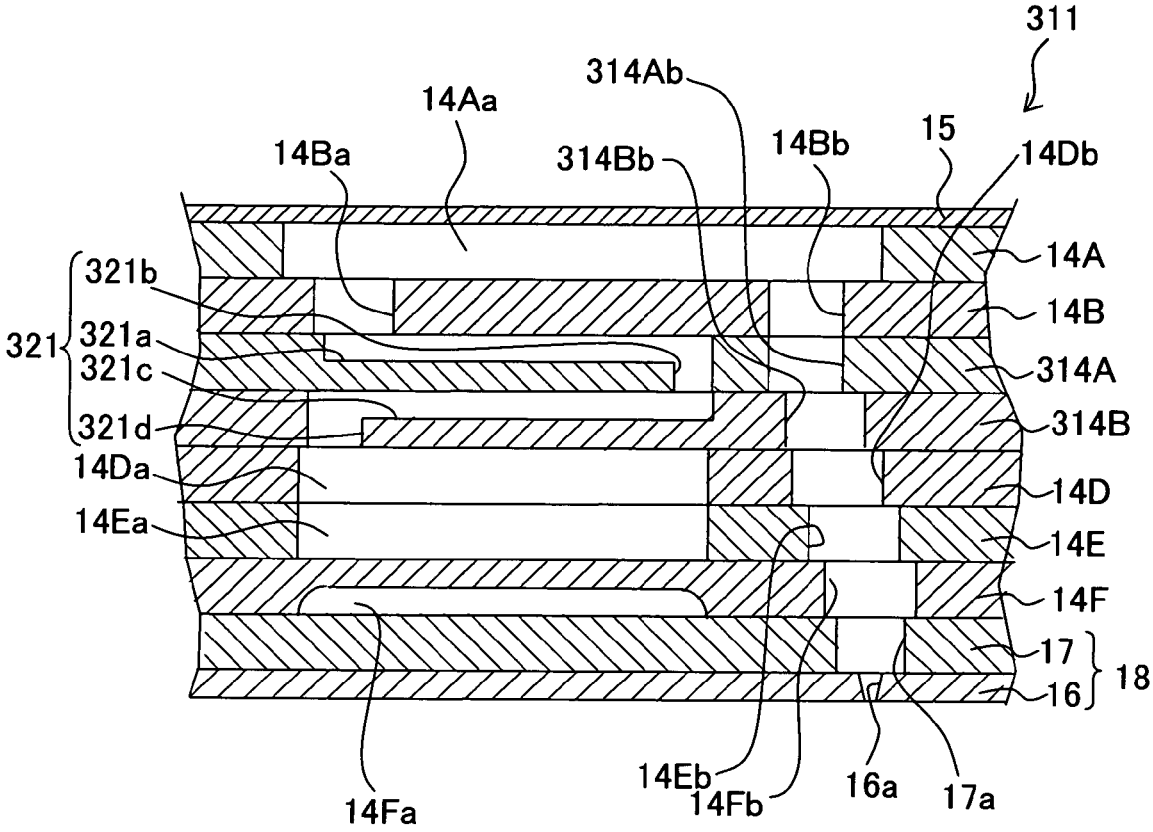
FIG. 14 is a cross-sectional view taken along a line XIV-XIV shown in FIG. 13.
Figure 15:
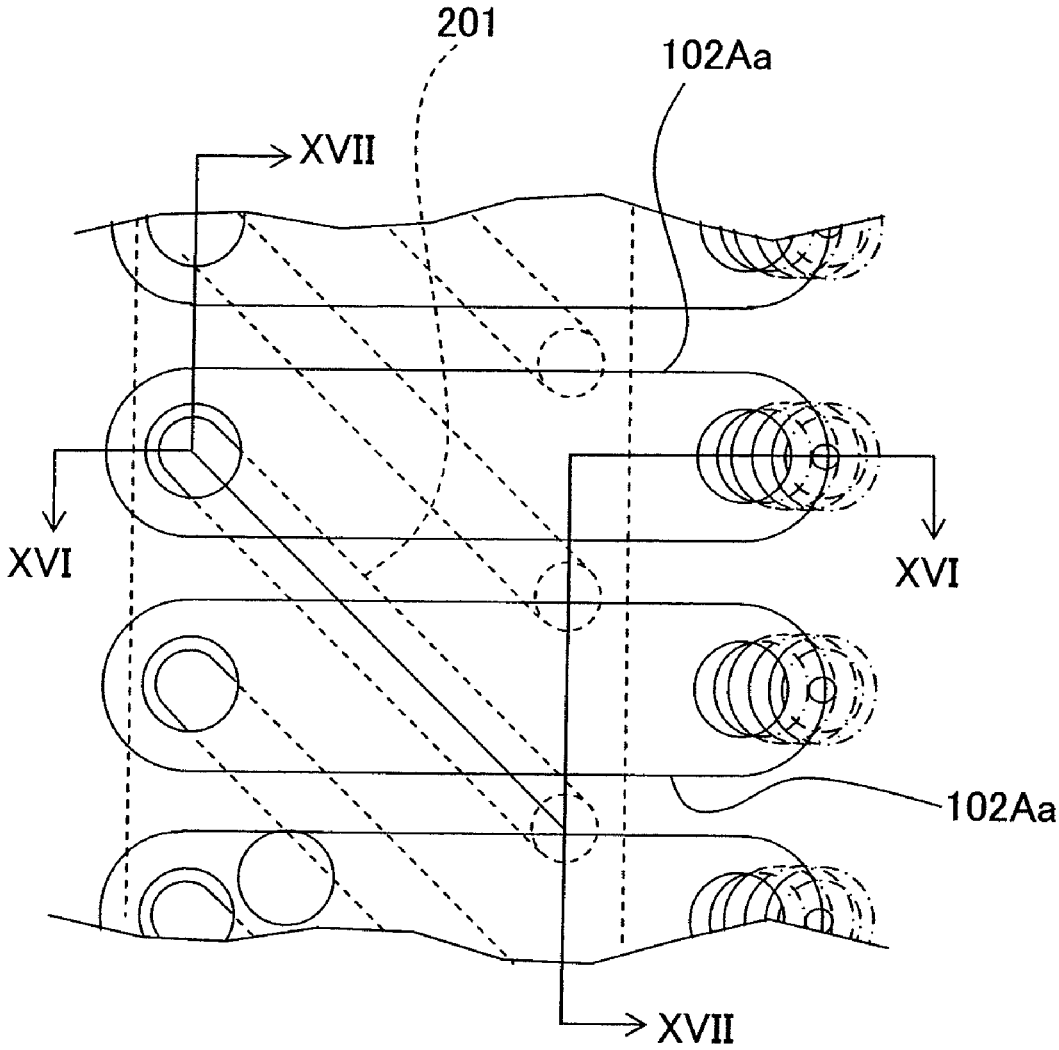
Fig. 15 Prior Art
FIG. 15 is a diagram corresponding to FIG. 4 of a cavity plate in a prior art.
Figure 16:
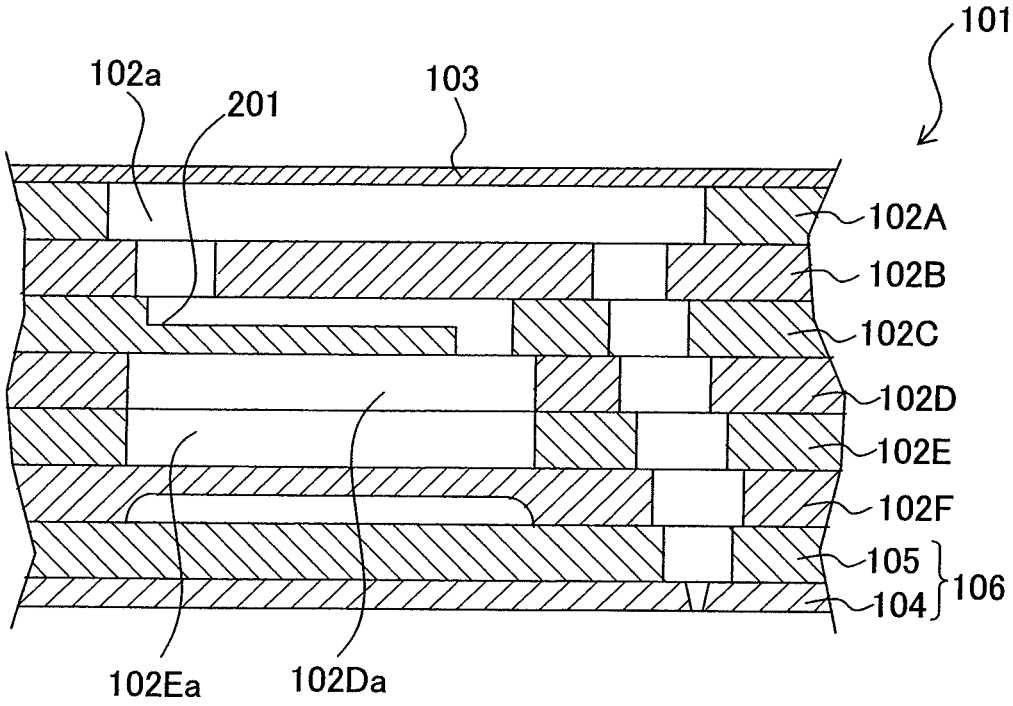
Fig. 16 Prior Art
FIG. 16 is a cross-sectional view taken along a line XVI-XVI shown in FIG. 15.
Figure 17:
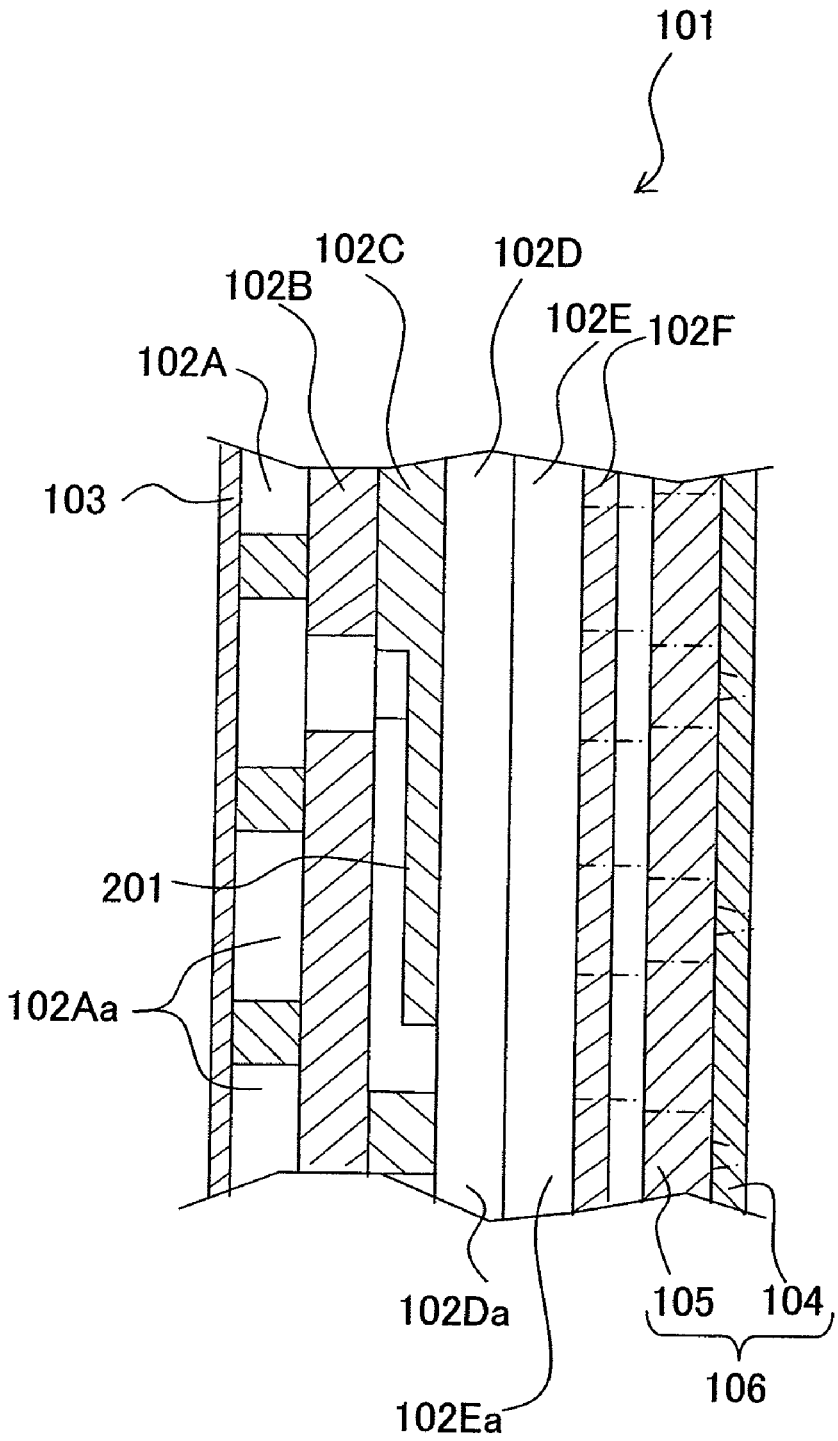
Fig. 17 Prior Art
FIG. 17 is a cross-sectional view taken along a line XVII-XVII shown in FIG. 15.

The communicating channels are not necessarily required to be formed in the same plane (flat surface), and may be formed three dimensionally as shown in FIG. 13. A cavity plate 311 shown in FIG. 13 includes two aperture plates 314A and 314B instead of the aperture plate 14C. In these two aperture plates 314A and 314B, communicating holes 321, and communicating holes 314Ab, and 314Bb are formed. Here, the communicating holes 314Ab communicate with the communicating holes 14Bb and the communicating holes 314Bb. The communicating holes 314Bb further communicate with the communicating holes 14Db, and channels which communicate from the pressure chambers 14Aa to the nozzles 16*a* are formed in the cavity plate 311. Moreover, the communicating channels 321 include first grooves 321*a*, second grooves 321*c*, communicating holes 321*b*, and communicating holes 321*d*. Here, in the aperture plate 314A, the first grooves 321*a*, each of which one end communicates with the communicating hole 14Ba, and which are extended toward the communicating holes 314Ab, and the communicating holes 321*b* which are formed at positions overlapping with the other end of the first grooves 321*a* are formed. In the aperture plate 314B, second grooves 321*c*, each of which one end communicates with the communicating hole 321*b*, and which are extended parallel to the first grooves 321*a*, and the communicating holes 321*d* which are formed at positions overlapping with the communicating holes 14Ba are formed. Accordingly, channels passing from the manifold 14Da to the pressure chambers 14Aa via the communicating channels 321 and the communicating holes 14Ba are formed.

In the third modified embodiment, the second grooves 321*c* are formed in areas of the aperture plate 314B, overlapping with the first grooves 321*a* in a plan view. However, the first grooves 321*a* and the second grooves 321*c* are not necessarily required to overlap in a plan view, and may be formed in any area. Moreover, in the third embodiment, communicating channels in which U-turn passes (returning passes) are formed in a lengthwise direction (direction of thickness of the cavity unit), are formed by using two aperture plates. However, more than two aperture plate may be used, and the communicating channels each having a plurality of turns may be formed. Or it is also possible to form communicating channels by forming grooves formed in both surfaces of one aperture plate, and communicating holes which make the grooves on two sides communicate. Moreover, in the embodiment and the modified embodiments, a cross-sectional shape, a length and/or position of the communicating channels may be selected voluntarily.

What is claimed is:

1. A head for an ink-jet printer which jets an ink on a recording medium, the head comprising:

a cavity unit comprising: a plurality of nozzle holes; a plurality of pressure chambers arranged on a plane which communicate with the nozzle holes respectively; a manifold which stores the ink to be supplied to the pressure chambers; communication channels which are formed separately to correspond to the pressure chambers, respectively, and in each of which a first communicating portion communicating with a corresponding one of the pressure chambers, a second communicating portion communicating with the manifold, and a turning portion between the first communicating portion and the second communicating portion are formed; and an energy imparting mechanism which imparts a jetting energy to the ink in the pressure chambers, wherein the pressure chambers have an elongated shape; and each of the communication channels comprises a first straight portion which is extended in a longitudinal direction of one of the pressure chambers from the first communicating portion, and a second straight portion which is extended parallel to the first straight portion from the second communicating portion, wherein the turning portion communicates with a front end of the first straight portion and a front end of the second straight portion.

2. The head according to claim 1, wherein:

the cavity unit is constructed of a stack formed by stacking a plurality of plates including an upper side plate in which the pressure chambers are formed, a lower side plate in which the second communicating portion of each of the communication channels is formed, and an intermediate plate provided between the upper side plate and the lower side plate and in which the first communicating portion of each of the communication channels is formed; and each of the communication channels comprises a recessed portion formed as a recess in a plate forming the stack.

3. The head according to claim 2, wherein the recessed portions of the communication channels are formed in a lower surface of the intermediate plate.

4. The head according to claim 2, wherein the recessed portions of the communication channels are formed in an upper surface of the lower side plate.

5. The head according to claim 2, wherein the first straight portion and the second straight portion of each of the communication channels are formed on planes respectively, the planes being different in a direction of a thickness of the plates.

6. The head according to claim 1, wherein the turning portion is a U-turn channel.

7. The head according to claim 1, wherein each of the communication channels communicates only with the corresponding one of the pressure chambers and the manifold.

8. The head according to claim 1, wherein the communication channels are shaped differently than the manifold.

9. The head according to claim 1, wherein the communication channels communicate with the manifold only through the second communicating portions.

10. An ink-jet printer which performs recording on a recording medium by jetting an ink on the recording medium, the ink-jet printer comprising:

a head comprising:

a cavity unit formed with a plurality of nozzle holes, a plurality of pressure chambers arranged on a plane and communicating with the nozzle holes respectively, a manifold which stores the ink to be supplied to the pressure chambers, communication channels which are formed separately to correspond to the pressure chambers, respectively, and in each of which a first communicating portion communicating with a corresponding one of the pressure chambers, a second communicating portion communicating with the manifold, and a turning portion between the first communicating portion and the second communicating portion are formed; and an energy imparting mechanism which imparts a jetting energy to the ink in the pressure chambers, wherein the pressure chambers have an elongated shape; and each of the communication channels comprises a first straight portion which is extended in a longitudinal direction of one of the pressure chambers from the first communicating portion, and a second straight portion which is extended parallel to the first straight portion from the second communicating portion, wherein the turning portion communicates with a front end of the first straight portion and a front end of the second straight portion;

a carriage which is movable while supporting the head; and a control mechanism which is connected to the head and the carriage, and which supplies a predetermined operation signal to the energy imparting mechanism, and supplies a control signal for controlling a movement of the carriage to the carriage.

11. A head for an ink-jet printer which jets an ink on a recording medium, the head comprising:

a cavity unit comprising: a plurality of nozzle holes; a plurality of pressure chambers arranged on a plane which communicate with the nozzle holes respectively; a manifold which stores the ink to be supplied to the pressure chambers; communication channels which are formed separately to correspond to the pressure chambers, respectively, and in each of which a first communicating portion communicating with a corresponding one of the pressure chambers, a second communicating portion communicating with the manifold, and a turning portion between the first communicating portion and the second communicating portion are formed, wherein the turning portion is a U-turn channel; and an energy imparting mechanism which imparts a jetting energy to the ink in the pressure chambers.

12. The head according to claim 11, wherein the communication channels overlap with the pressure chambers which communicate with the communication channels, respectively.

13. The head according to claim 11, wherein the communication channels overlap entirely with the pressure chambers which communicate with the communication channels, respectively.

14. The head according to claim 11, wherein the communication channels are formed in a same surface parallel to the plane.

15. The head according to claim 11, wherein the bent portion of each of the communication channels is extended in a direction different from a plane direction of the plane.

16. The head according to claim 11, wherein the communication channels are arranged such that a communication channel among the communication channels does not overlap with a pressure chamber, among the pressure chambers, which is adjacent to another pressure chamber communicating with the communication channel.

17. The head according to claim 11, wherein a length of each of the communication channels is greater than a direct distance between the first communicating portion and the second communicating portion.

18. An ink-jet printer which performs recording on a recording medium by jetting an ink on the recording medium, the ink-jet printer comprising:

a head comprising:

a cavity unit formed with a plurality of nozzle holes, a plurality of pressure chambers arranged on a plane and communicating with the nozzle holes respectively, a manifold which stores the ink to be supplied to the pressure chambers, communication channels which are formed separately to correspond to the pressure chambers, respectively, and in each of which a first communicating portion communicating with a corresponding one of the pressure chambers, a second communicating portion communicating with the manifold, and a turning portion between the first communicating portion and the second communicating portion are formed, wherein the turning portion is a U-turn channel; and an energy imparting mechanism which imparts a jetting energy to the ink in the pressure chambers, a carriage which is movable while supporting the head; and a control mechanism which is connected to the head and the carriage, and which supplies a predetermined operation signal to the energy imparting mechanism, and supplies a control signal for controlling a movement of the carriage to the carriage.

* * * * *